United States Patent [19]

Evans

[11] 4,296,874

[45] Oct. 27, 1981

[54] BALL HOLDER

[76] Inventor: Roger C. Evans, 10214 Dogwood Ave., Palm Beach Gardens, Fla. 33410

[21] Appl. No.: 746,592

[22] Filed: Dec. 1, 1976

[51] Int. Cl.[3] ..... B65D 85/58

[52] U.S. Cl. ..... 221/307; 206/315 B; 224/919

[58] Field of Search ..... 221/307, 309, 310; 222/213; 224/5 D, 919; 211/14, 15; 206/315 B

[56] References Cited

U.S. PATENT DOCUMENTS

| | | | |
|---|---|---|---|
| 2,546,709 | 3/1951 | Abarr | 222/213 |
| 2,960,259 | 11/1960 | Aveni | 133/5 A |
| 3,412,897 | 11/1968 | Slater | 221/310 X |
| 3,777,933 | 12/1973 | Joliot | 224/50 X |
| 3,851,656 | 12/1974 | Haas et al. | 133/5 A |
| 4,020,974 | 5/1977 | Bauer et al. | 221/307 |

*Primary Examiner*—F. J. Bartuska
*Attorney, Agent, or Firm*—Jack N. McCarthy

[57] ABSTRACT

A tubular device for holding balls and dispensing them. The device is shaped spherically at the bottom and supports the balls therein and is formed of elastic or resilient material, a slot at the bottom can be opened by temporarily deforming the device by hand, this will release one or more balls.

1 Claim, 5 Drawing Figures

BALL HOLDER

BACKGROUND OF THE INVENTION

This invention relates to holding and dispensing balls from the bottom of a resilient-tubular member.

Patents of interest are the following: U.S. Pat. No. Re. 24,166; U.S. Pat. Nos. 3,777,933; 3,756,299 and 3,851,656.

SUMMARY OF THE INVENTION

It is an object of this invention to carry and support a plurality of balls for transportation while having them readily dispensable therefrom when desired.

It is a further object of this invention to have its balls dispensed in an order in reverse to the order in which they were placed in the device.

It is another object of this invention to have the balls supported by the bottom end of the tubular member which is spherical and matches the contour of the balls supported; this is especially advantageous for heavy balls, such as golf balls, said end having a slot therein which can be opened by deforming the end which is formed of resilient or elastic material and which is self-closing.

DESCRIPTION OF THE PREFERRED EMBODIMENT

Figure 2:
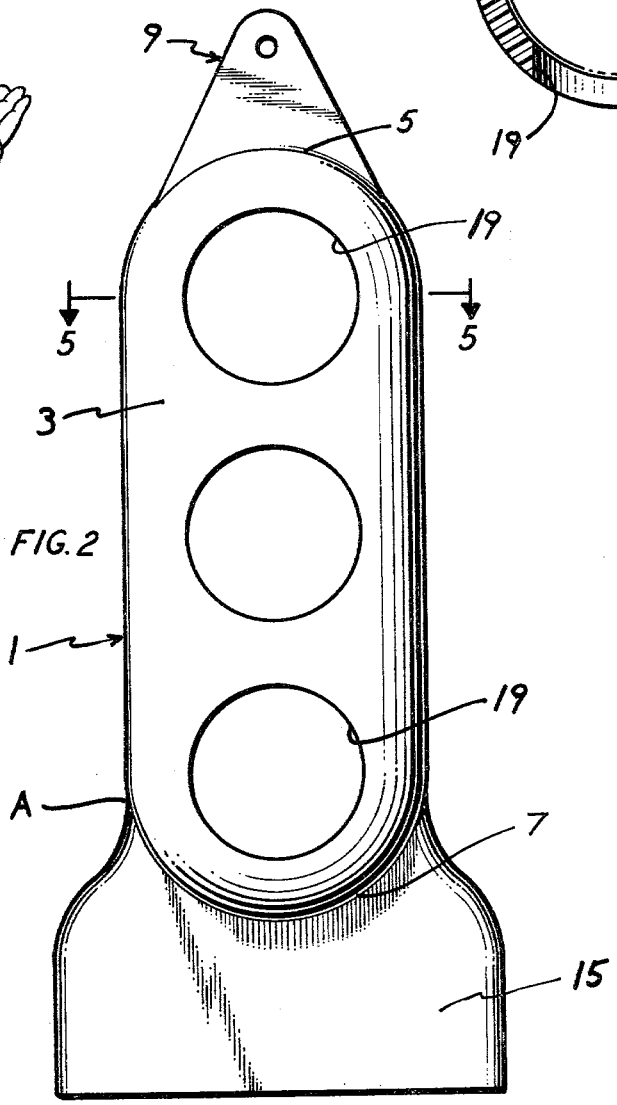
FIG. 2 is a side elevational view of the ball holder.
Figure 3:
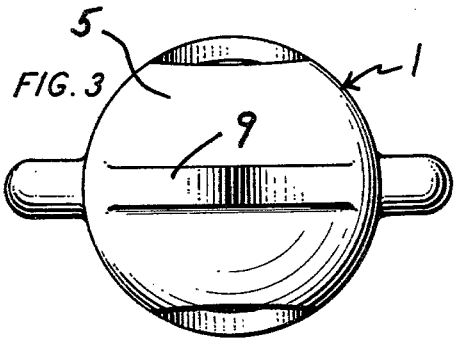
FIG. 3 is a top view of FIG. 2.
Figure 4:
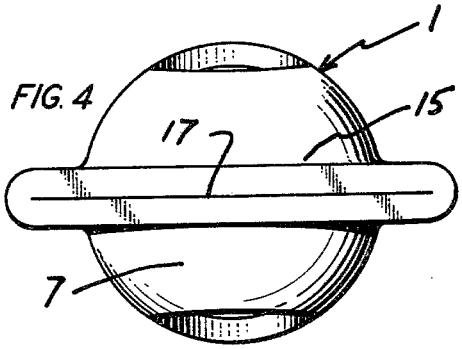
FIG. 4 is a bottom view of FIG. 2.

Referring to the drawings, FIG. 2 shows a ball holder 1 having a tubular body 3 with rounded top end 5 and bottom end 7. The top end 5 is solid and formed having a holding tab 9 which can be attached to a golf bag, cart or any place desired. The bottom end 7 is split through a point approximately aligned with the centerline of the tubular member 3 to the full diameter of the tubular member 3 as at A. At this point the ball holder 1 is formed as a flattened tubular member 15. The split extending from within the tubular body 3 to the exterior of the ball holder 1 through the slot 17 formed by the flattened tubular member 15. Holes 19 are provided to view the balls in the holder 1.

The ball holder 1 can be formed of rubber, plastic, or other suitable elastic or resilient material. Materials for this device are well known in the art and described in U.S. Pat. No. Re. 24,166, and U.S. Pat. No. 3,851,656. The ball holder 1 could have the upper portion above point A of a more rigid material since its resiliency is not necessary for the inserting or dispensing operation.

Figure 1:
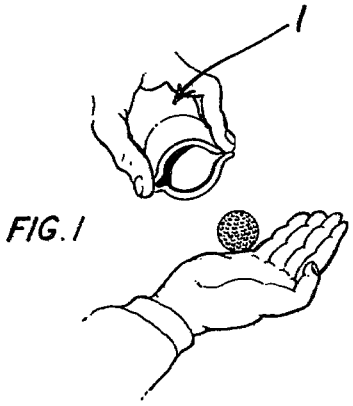
FIG. 1 is a perspective view showing the slot distorted to an open position for dispensing a ball.
Figure 5:
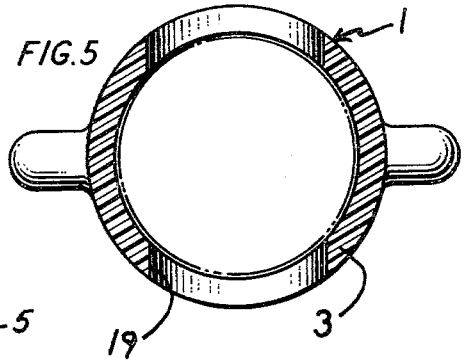
FIG. 5 is a view along the line 5—5 of FIG. 2.

The flattened tubular member 15 can be squeezed to open it to a size greater than the size of the balls being carried so they can drop through the opening—see FIG. 1.

I claim:

1. A ball holder comprising a tubular body member for holding balls, said tubular body member having a bottom for supporting balls, said bottom having a slot therein, a flattened tubular member extending from the bottom of said tubular body member around said slot and forming the bottom end of the holder, said tubular body member having a closed top, said top having a holding means for supporting the ball holder, said bottom of said tubular body member and said flattened tubular member being formed of a resilient material so that they can be temporarily deformed to a size to permit a ball to pass therethrough, the interior of the bottom of the tubular body member being spherically shaped for matching the contour of the balls being held to support a ball by having surface contact.

* * * * *